United States Patent [19]

Gordon

[11] Patent Number: 5,016,750

[45] **Date of Patent: * May 21, 1991**

[54] ENVIRONMENTALLY SOUND CARRIER PACKAGE

[76] Inventor: Joan E. Gordon, 260 E. Chestnut St., Chicago, Ill. 60611

[ * ] Notice: The portion of the term of this patent subsequent to May 15, 2007 has been disclaimed.

[21] Appl. No.: 437,652

[22] Filed: Nov. 16, 1989

Related U.S. Application Data

[63] Continuation-in-part of Ser. No. 385,228, Jul. 25, 1989, Pat. No. 4,925,020.

[51] Int. Cl.[5] ..... B65D 75/58

[52] U.S. Cl. ..... 206/150; 206/620; 206/824; 206/813

[58] Field of Search ..... 206/824, 813, 150, 151, 206/620, 145

[56] References Cited

U.S. PATENT DOCUMENTS

| | | | |
|---|---|---|---|
| 2,997,169 | 8/1961 | Poupitch . | |
| 3,350,131 | 10/1967 | Tanzer . | |
| 3,504,790 | 4/1970 | Owen . | |
| 3,721,337 | 3/1973 | Braun et al. . | |
| 4,024,950 | 5/1977 | Werth | 206/150 |
| 4,064,989 | 12/1977 | Olsen | 206/428 |

FOREIGN PATENT DOCUMENTS

| | | | |
|---|---|---|---|
| 963852 | 3/1975 | Canada | 206/150 |
| 963855 | 3/1975 | Canada | 206/150 |

*Primary Examiner*—William I. Price

*Attorney, Agent, or Firm*—Neuman, Williams, Anderson & Olson

[57] ABSTRACT

A container package includes a series of similarly configured containers maintained in adjacent relation by a series of interconnected rings formed from a resilient deformable material each surrounding one of the containers of the container package. The rings may have one or more weakened portions that rupture in response to stress applied by a link connecting the ring to the container as the container is removed. The link may be an adhesive that attaches the ring to the container at a point adjacent a weakened portion or alternatively may be a bracket straddling the ring. Alternatively, a bracket having an inner cutting edge may straddle the ring. The cutting edge severs the ring as the container is removed from the package. The rupture of the ring in each of these embodiments prevents wildlife from becoming entangled in unruptured rings of plastic carriers once the package is discarded.

20 Claims, 2 Drawing Sheets

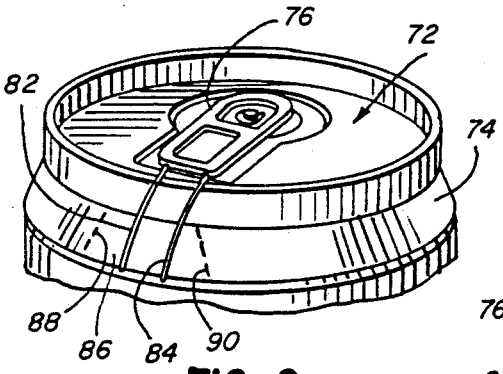
FIG. 9
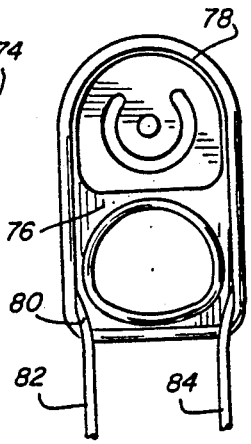
FIG. 10
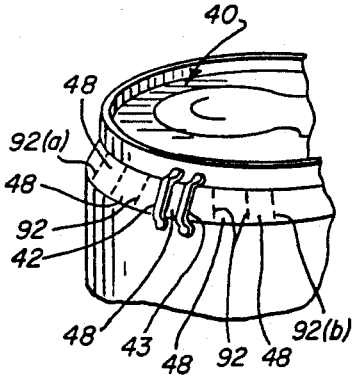
FIG. 11
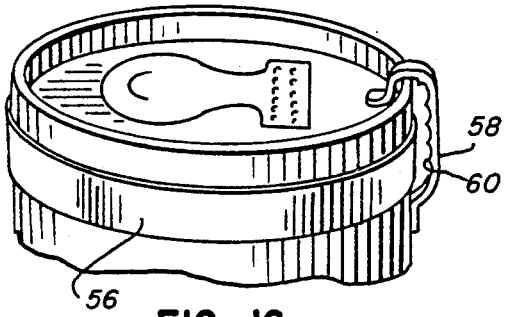
FIG. 16
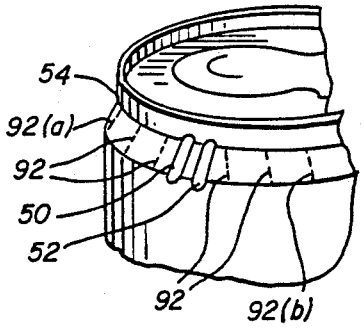
FIG. 12
FIG. 17
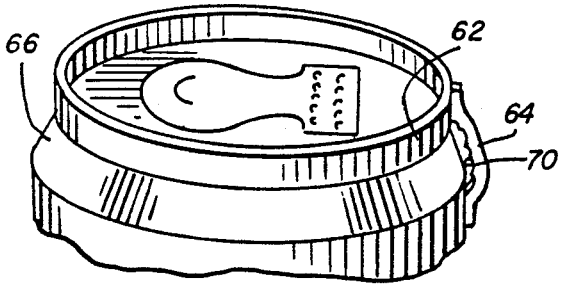
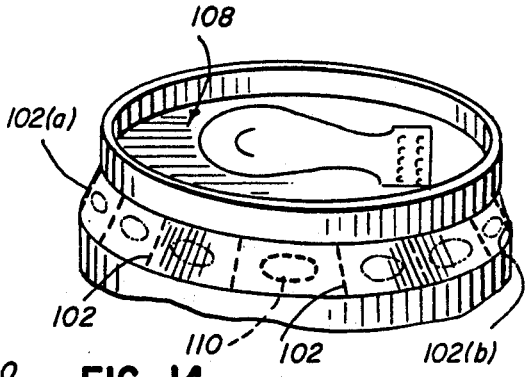
FIG. 14
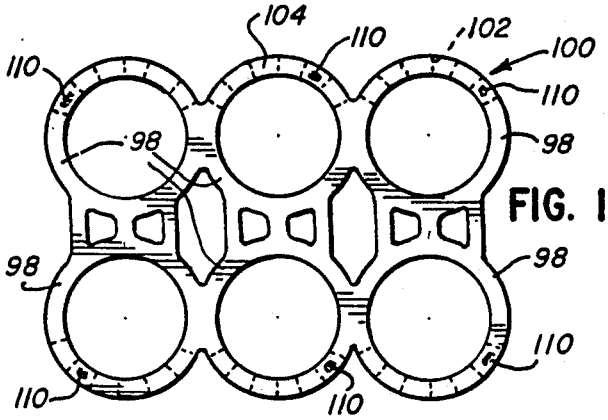
FIG. 13
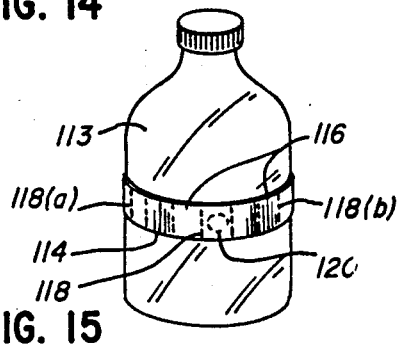
FIG. 15

ENVIRONMENTALLY SOUND CARRIER PACKAGE

BACKGROUND OF THE INVENTION

This application is continuation-in-part of copending U.S. application Ser. No. 07/385,228 for "Environmentally Sound Carrier Package" filed July 25, 1989 now U.S. Pat. No. 4,925,020.

FIELD OF THE INVENTION

The invention relates to an environmentally sound container package of the type that includes a carrier device for maintaining a number of similar containers in adjacent relation for ease of handling. More particularly the invention relates to a release mechanism by which the removal of individual containers from the carrier necessarily breaks the continuity of the rings in which the containers are housed by providing a physical connection between each ring and the container it houses.

DESCRIPTION OF THE PRIOR ART

Over recent years there has been growing awareness of the effect on the environment of the vast quantities of non-biodegradable waste products generated each year. Of particular concern in this respect are non-biodegradable plastics products, 20 million tons of which are produced each year by the United States alone. Plastics are more difficult to dispose of than other waste products as they cannot readily be recycled because of risk of contamination and are often not suitable for burning as they may release toxic substances such as dioxins. The alternatives for disposal are therefore limited to burying plastic waste in landfills, or dumping it in the ocean where it can directly affect wildlife. As new sites for landfills are becoming increasingly difficult to establish due to resistance from residents in the vicinity of proposed sites, dumping at sea is often resorted to although illegal. Dumping in smaller bodies of water also exists as a result of waste cast off by recreational boaters all over the world.

Many types of plastic packaging are a direct danger to wildlife. Recently, public attention has been alerted to the dangers to wildlife of the plastic yokes commonly used in six-packs to hold cans and bottles together. The removal of cans or bottles from a yoke typically leaves the rings that were surrounding the bottles unbroken. A large proportion of these yokes find their way into the ocean and other waterways where tragically wildlife such as seals, turtles, fish and birds can become hopelessly entangled in the rings. They can also be a danger to both wild and domestic land animals prior to emergence in the ocean or other waterways as yokes can be found at landfills and other exposed sites easily accessible to such animals. When entangled, these animals are likely to perish due to strangulation, starvation, or infection developed as a result of the plastic cutting into flesh.

Ultimately it is desirable for all plastics to be degradable, and/or recycled but although some progress has been made in these respects, research and development and commercial considerations have limited the present extent of their market penetration. Even if these ideals are achieved, yokes made from degradable plastics might still be lethal to wildlife prior to degradation. It is obviously desirable therefore to provide a carrier for a container package, such as a six-pack yoke, that does not present a danger of entanglement to wildlife.

The present invention provides such a carrier that is compatible with degradability as it currently exists and that minimizes the danger of animal entanglement by ensuring that the rings of the carrier are ruptured on removal of each can or bottle from a carrier.

OBJECTS OF THE INVENTION

Accordingly it is an object of this invention to provide an improved carrier package that meets the aforementioned requirements.

It is a specific object of this invention to provide a carrier package that poses significantly less threat to the environment than existing plastic container packages.

It is a more specific object of this invention to provide a carrier package that is less likely to endanger wildlife through entanglement than existing plastic carriers.

It is a another object of this invention to provide a carrier that is rendered less detrimental to wildlife prior to disposal, by the performance of operations necessary for the removal of a can, bottle, or other large container from its carrier.

Other objects, advantages and features of this invention will become apparent on reading the following detailed description and appended claims and upon reference to the accompanying drawings.

SUMMARY OF THE INVENTION

In accordance with one embodiment of this invention a container package which achieves the foregoing objects includes a series of similarly configured containers maintained in adjacent relation by a series of interconnected rings formed from a resilient deformable material each surrounding one of the containers of the container package. Connection means attaches each of the containers to the ring that surrounds it and rupture means facilitates breach of the continuity of each ring on removal of the container it engages from the container package.

The connection means can be a metal brad straddling the girth of the ring that has an inner cutting edge nearest the container that provides the rupture means. As the container is removed from the package the cutting edge makes contact with the ring. The brad is firmly fixed to the container so that as the container is removed from the package, the brad remains attached to the container and the cutting edge severs the ring. The cutting edge is preferably serrated. The strength of the attachment of the metal brad to the container must be greater than the strength of resistance of the ring to rupture by the cutting edge in order that the brad remains attached to the container and the ring is necessarily severed by the cutting edge as the container is removed from the package.

The connection means could alternatively be a pair of metal brads that straddle the ring but do not have inner cutting edges. The ring may then have a plurality of perforated lines situated between first and second locations on the ring that define a number of weakened portions extending across the girth of the ring and comprising the rupture means. The weakened portions facilitate breach of the continuity of the ring as the ring is tearable at these portions in response to removal of a container. The plurality of weakened portions enable the brads to be positioned in a number of different locations around the ring between the first and second locations reducing the requirement for precise orientation of the container. The nearest two perforated lines will rupture and the weakened portion defined thereby will be removed from the ring on removal of a container.

Alternatively the connection means may be one or more fibers connected to the ring preferably by pressure sealing. For convenience in a push-tab can, the fiber or fibers may be attached to the push-tab that has a hollow fold of metal around the underside perimeter. The fiber or fibers may be threaded through this fold thereby attaching it to the tab. The attachment may be further strengthened by adhesive. The free ends of the fiber or fibers can then be pressure sealed to the weakened portion of the ring, one proximate each of the perforated lines. The strength of the connection between the container and the ring must be greater than the strength of the weakened portion of the ring so that the continuity of the ring is necessarily broken at the weakened portion as the container is removed from the container package.

Another alternative connection means is provided by an adhesive that attaches each ring to the container it surrounds. A single spot of adhesive joining a ring to the container it engages can be placed at a number of locations between the first and second locations on the ring. The two perforated lines nearest the adhesive will rupture on removal of each container from engaging ring and the portion defined thereby will remain attached to the container. The ring is thereby broken.

BRIEF DESCRIPTION OF THE DRAWINGS

For a more complete understanding of this invention, reference should now be made to the embodiment illustrated in greater detail in the accompanying drawings and described by way of example only. In the drawings:

FIG. 9 is a partial perspective view of a can showing a fiber connection between the push-tab and the yoke.

FIG. 10 is a perspective view of the underside of a push-tab showing the connection between the fiber and the push-tab of the arrangement of FIG. 9.

FIG. 11 is a partial perspective view of a can showing a pair of brads connecting a can to a yoke having multiple perforated lines extending across its girth.

FIG. 12 is a perspective view of a can showing an embodiment similar to that of FIG. 11, having an alternative brad configuration.

FIG. 13 is a top view of a yoke having multiple perforated lines showing different locations for the adhesive attachment.

FIG. 14 is a perspective view of a can attached by adhesive to a yoke having multiple perforated lines.

FIG. 15 is a partial perspective view of a bottle attached to a yoke by adhesive.

FIG. 16 is a perspective view of a can attached to a carrier yoke by a brad having a serrated cutting edge on its inner side.

FIG. 17 is a partial perspective view of a can attached to a carrier by an alternatively configured brad having an inner serrated cutting edge.

DETAILED DESCRIPTION OF THE DRAWINGS

Figure 1:
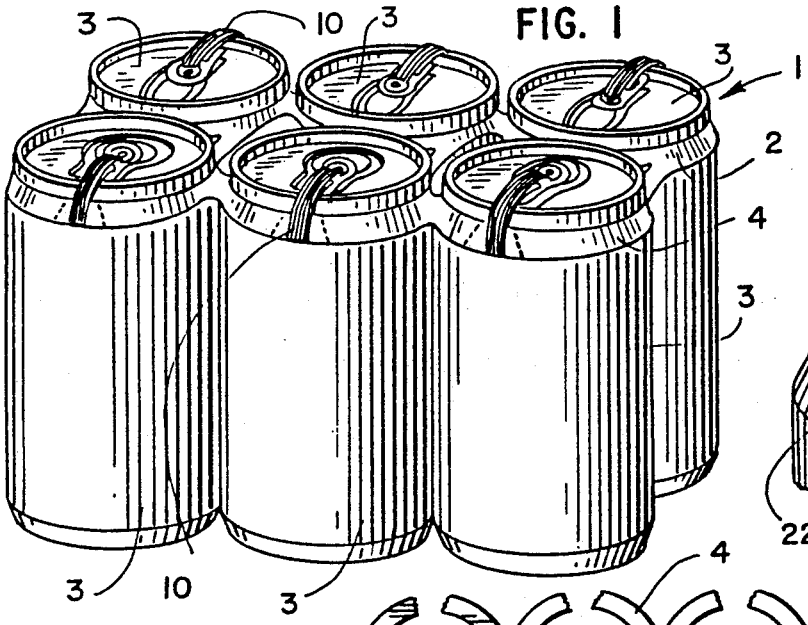
FIG. 1 is a perspective view of a six-pack of push-tab cans of one embodiment of this invention.

Turning to FIG. 1 a perspective view of a six-pack 1 can be seen showing a yoke 2 for holding a series of similar push-tab cans each designated 3. Each can 3 is maintained in its position relative to the other cans of the six-pack by the yoke 2. Each can 3 is engaged by one of the interconnecting rings 4 that make up the yoke 2.

Figure 3:
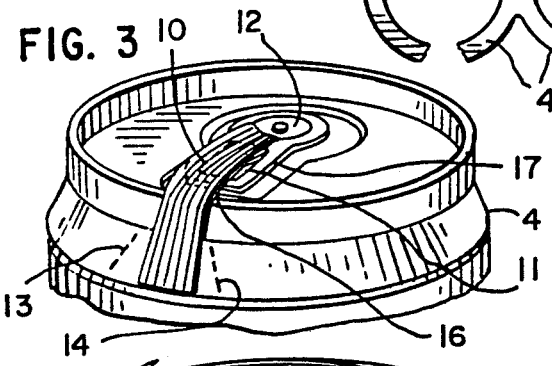
FIG. 3 is a partial perspective view of one of the cans of FIG. 1 showing the connection between the yoke and the push-tab.

In FIG. 3 the design of the connection between the cans 3 and the rings 4 can be seen more clearly. A plastic strip 10 is passed through both apertures 11, 12 of the push-tab as shown. Both ends of the plastic strip are heat sealed to the ring 4. The ring 4 has perforated lines 13, 14 located one on either side of the point of attachment of the strip 10 to the ring 4, to weaken the ring so that it is tearable in response to removal of the can from the ring. The perforated lines are preferably formed having as many small holes, as close together as possible compatible with maintaining the integrity of the yoke 2 prior to removal of a can 3. Other means of weakening the ring such as scoring lines on the plastic could perhaps be utilized.

Figure 2:
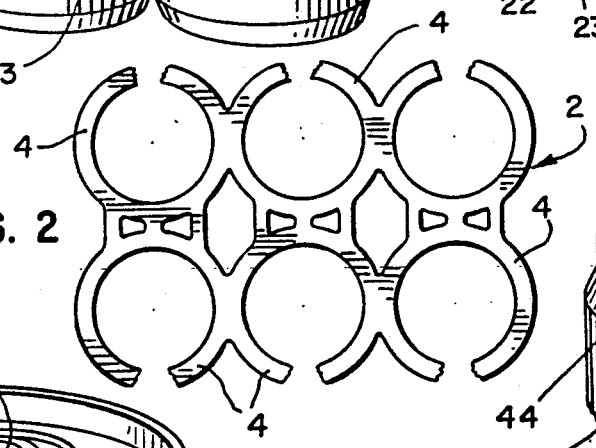
FIG. 2 is a top elevation of the yoke of FIG. 1 after the removal of all the cans retained therein.
Figure 4:
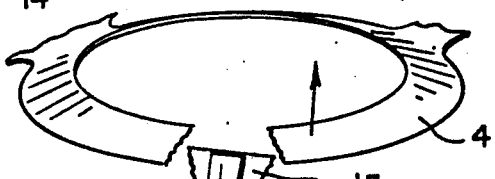
FIG. 4 is a partial perspective view of one of the cans of FIG. 1 on removal from the yoke.
Figure 4:
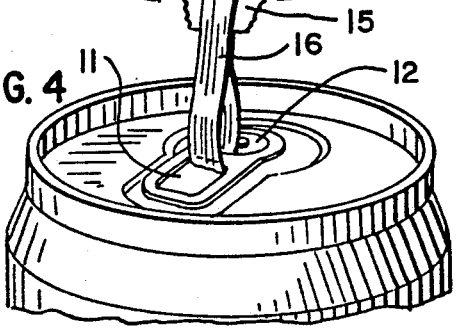

The yoke 2 is designed so that removal of a can is achieved in a conventional manner by a customer-familiar downward pull on the can. As this familiar action is executed, the can 3 is decoupled from engagement with the ring 4 leaving the strip 10 as the only connection between the can 3 and the ring 4. The weakened lines 13, 14 yield as the can 3 is removed from the yoke 2 and the ring 4 is ruptured as shown in FIG. 4 with the strip 10 and detached portion 15 of the ring 4 remaining attached to the can 3. Once all the cans are removed, each of the rings are ruptured and the yoke will appear as shown in FIG. 2. This arrangement at the connection has the advantage of utilizing apertures 11, 12 already existing in the push-tab 17 of the can to connect the can to the yoke, reducing the number of additions to the can necessary to implement the invention. The strip by necessity should connect the can to the yoke by utilizing both the inner and outer apertures 11 and 12 of the push-tab 17 since passing the plastic strip through just the outer aperture 12 results in premature opening of the can.

The most important characteristic of the physical connection between the can and the ring is its strength. For additional strength and to prevent possible breakage of the plastic strip prior to removal of the can, one or more strands of fiber 16 may be pressure sealed along the length of the strip, thus lessening the chance of the plastic strip being severed by a sharp object or rough edges on the can. Alternatively the plastic strip 10 may be entirely replaced by strands of fiber of the required strength. This arrangement may be preferable as some fibers are less prone to severance than plastic and are degradable. Their use therefore avoids increasing the tonnage of non-degradable waste produced each year.

The amount of additional plastic involved in the connection between the can and the yoke, is, however, insignificant when compared with the benefits of making the carrier safe against entanglement, thus saving the lives of thousands of wildlife.

None of the strips 10 connecting the yoke to the cans 3 must break under the force required to rupture the ring at the perforated lines 13, 14 to ensure that the rupture of ring 4 is guaranteed on removal from the yoke 2. As each can is removed in this manner each ring in turn is ruptured until the yoke 2 has no remaining unruptured rings and is configured as shown in FIG. 4. As none of the rings remain intact, on disposal, the yoke does not pose a threat to wildlife as animals are no longer in danger of being entangled in unruptured rings.

Turning now to FIGS. 9 and 10, an alternative means of attachment between a can 72 and a yoke 74 can be seen. The push-tab 76 of the can 72 has a hollow fold of metal 78 underpinning the underside perimeter. A fiber or group of fibers 80 is threaded through this hollow fold and may also be held in position by adhesive (see FIG. 10) although it may be more easily fabricated if no adhesive is used. Ends 82 and 84 of the fiber extend beyond the push-tab 76 and are pressure sealed to the weakened portion 86 of the yoke 74 between the two perforated lines 88, 90. On removal of the can from the container by the customer-familiar downward pull, the yoke 74 is ruptured at the perforated lines 88, 90 and the weakened portion 86 is removed from the ring. This embodiment has the advantage of requiring no additional plastic for its implementation.

Figure 5:
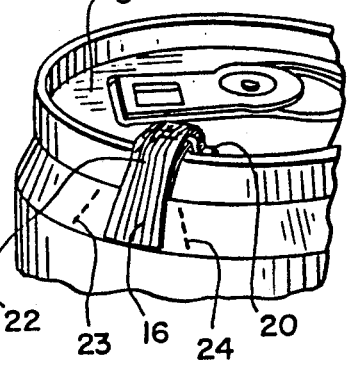
FIG. 5 shows a partial perspective view of a push-tab can having an alternative arrangement for the connection of the can to the yoke.

A further embodiment of the invention for connecting a push-tab type can 3 to a yoke 2 can be seen in FIG. 5. This means of attachment includes an eyelet 20, welded or otherwise connected to the top of the can 3. A strip of fiber reinforced plastic 22 is passed through the eyelet 20 and bent back on itself as shown. Both ends of the plastic strip are heat sealed to the yoke 2 and lines of perforations 23, 24 weaken the rings of the yoke so that the continuity of the ring is broken as the can 3 is pulled from the yoke 2 in a similar manner to that described for the cans of FIG. 1. The eyelet 20 is located close to the edge of the can to minimize the length of strip 22 necessary to complete the physical connection between the ring 4 and the can 3. In this position the eyelet would also not interfere with drinking from the can. It is also important that the eyelet does not have any sharp edges that might sever the plastic strip 5.

The advantage of this method of attachment resides in the fact that it is utilizable with a variety of types of can. This means that only one technological development is required to implement the invention whatever the can type. Moreover, in mass production of carriers according to this embodiment of the invention, the orientation of the can would not be critical to the positioning of the eyelet 20. Fabrication of the connection between the can and the yoke could therefore be achieved more economically.

Figure 6:
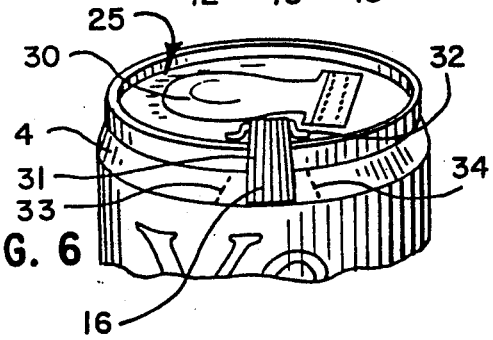
FIG. 6 is a perspective view of a foil top can having the can attached to the yoke in the same manner as the can of FIG. 5.
Figure 7:
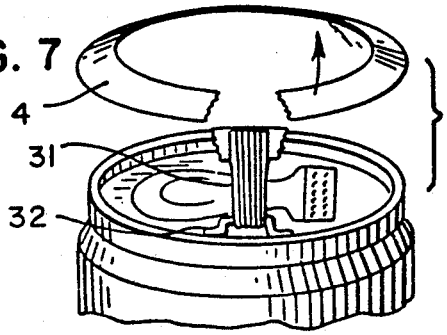
FIG. 7 is a perspective view of the can of FIG. 6 on removal from the yoke.

FIG. 6 shows an alternative design of can 25 that has a foil top 30. The design of the attachment between the yoke 2 and the can 25 is the same as for the push-tab can 3 shown in FIG. 5. A reinforced plastic strip 31 passes through an eyelet 32 and is sealed to the ring 4 of the yoke 2. On removal of the can 25 from the yoke 2, again in the conventional manner by a customer familiar downward pull on the can, the ring 4 is ruptured at perforated lines 33, 34 and the strip 31 and ring portion 35 remain attached to the can 25 as can be seen in FIG. 7. The detachment of the can illustrated in FIG. 5 from its surrounding ring would result in rupture of the ring in the same manner as that illustrated in FIG. 7.

Figure 8:
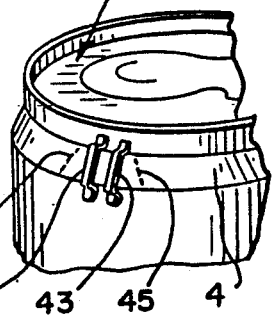
FIG. 8 is a perspective view of a can showing an alternative connection between the can and the yoke.

FIG. 8 shows an alternative embodiment that requires no additional plastic and requires minimal modification of the container for its implementation. This embodiment therefore has the advantage of being readily adaptable to automation of the assembling procedure.

The ring 4 is connected to the can 40 by a pair of metal brads 42, 43 one located in close proximity to each of the perforated lines 44, 45 of the ring. On removal of the can 40 from the ring 4 in the customer-familiar manner, the brads will engage with the ring causing it to rupture along the weakened lines. This will break the continuity of the ring and thus render the package less dangerous to wildlife in a manner similar to that described for the previous embodiments.

Further modifications of this arrangement can be seen in FIG. 11. In order that precise orientation between the positioning of the metal brads 42, 43 and the perforated lines 92 not be necessary, instead of just one pair of perforated lines being present on the yoke there are a number of such lines defining weakened portions 48 extending between perforated lines 92(*a*) and 92(*b*). The portion between the outer perforated lines 92(*a*) and 92(*b*) is likely to be approximately 60° of the periphery of the ring but may be greater or less depending upon the design of the yoke. This arrangement allows the brads to be placed in any of a number of locations around the can within the confines of perforated lines 92(*a*) and 92(*b*) as wherever the brads are positioned, the closest two perforated lines will rupture breaching the continuity of the ring as the container is removed. The use of multiple perforated lines to reduce the requirement for orientation of the container within the yoke may also be desirable with the alternative embodiments discussed above.

A further variation of the brad embodiment can be seen in FIG. 12. To facilitate stacking of the container packages, the brads 50, 52 are flush to the can. The yoke again has a number of perforated lines defining weakened portions 48. The flush brads 50, 52 straddle the yoke but do not protrude above the shoulder 54, of the can to prevent several similar container packages from standing in a stable stacking arrangement. In the arrangement shown in both FIG. 11 and FIG. 12, the brads break the yoke at the perforated line or lines nearest to the location of the brads. This is accomplished by the customer-familiar downward pull on the container.

FIGS. 13–15 disclose another embodiment of the invention that utilizes weakened portions in each of the rings to facilitate rupture. This embodiment is suitable for use with a variety of containers ranging from cans, to larger containers such as glass bottles. Each ring 98 of the yoke 100 seen in FIG. 13 has a number of perforated lines 102 defining a number of weakened portions 104 between lines 201(*a*) and 102(*b*). Spots of adhesive 110 can be placed at any location between a pair of perforated, not necessarily adjacent, lines to connect the ring to the container.

FIG. 14 shows a ring 98 similar to that depicted in FIG. 1 engaging a can 108. An adhesive spot 110 attaches the ring 98 to the can 108 and can be positioned at any of the alternative positions shown in broken lines or any intermediate position. Regardless of the position of the adhesive spot, provided it is between the outermost perforated lines 102(*a*) and 102(*b*), the two perforated lines closest to the spot 110 will rupture on removal of the can 108 from the ring 98 and a small section of the ring 112 will remain attached to the can 108, breaching the continuity of the ring 98.

A similar arrangement is shown in FIG. 15, where instead of a can, a glass bottle 113 is shown engaged by a ring 114 of a yoke. The ring 114 has a number of weakened portions 116 defined by perforated lines 118 and a spot of adhesive 120 attaches the ring 114 to the bottle 113. Again the spot can be located at any point between the two outermost perforated lines 118(*a*) and 118(*b*). A small portion of the ring 114 remains attached to the bottle 113 as the bottle 113 is removed from the ring 114 and ruptures at the two perforated lines 118 closest to the spot of adhesive 120.

In both the arrangements described above it is important that the adhesive adheres firmly to both the container and the ring of the yoke in order that the perforated lines 102 or 118 break in preference to detachment of the ring 98 or 114 from the container. The yokes of carrier packages are often manufactured from polyethylene and any adhesive that will adhere polyethylene to aluminum or glass will be suitable for attaching a yoke of polyethylene to glass bottles or aluminum cans. Other adhesives may be required if the materials of the containers and yokes differ from those specified above.

Two commercially available adhesives suitable for attaching both aluminum and glass to polyethylene are manufactured by CEIBA-GEIGY under the trademark ARALDITE. The first is an all purpose adhesive for industrial use, ARALDITE AW 106/HARDENER HV 953. The second is a high strength thixotropic adhesive for industrial use, ARALDITE AV 8113/HARDENER HV 8113. A layer of either of these adhesives 0.002 to 0.004 inches is recommended.

The adhesive may be applied to either the container or the yoke depending upon the preference of the packager. If the adhesive is applied to the container, the container must be oriented to align the spot of adhesive with a portion of a ring of the yoke that covers approximately 60° thereof in order that the spot coincides with a weakened portion defined by a pair of perforated lines. The orientation within that 60° is not however critical as even if the adhesive spot falls at a perforated line thereby securing two weakened portions to the container, the perforated lines on either side of the spot will rupture. This will result in two rather than one weakened portion retaining attached to the container on removal from the yoke and the continuity of the ring is breached equally successfully. The holes forming the perforated line are preferably sufficiently small to prevent significant seepage of the adhesive through the holes.

Alternatively the adhesive could be applied to the yoke rather than the container. In this case it may only be necessary for each ring to have one weakened portion defined by a single pair of perforated lines as the adhesive spot could be precisely placed between the two. Rings with multiple perforated lines may still however be preferable if precise placement of the spots of adhesive on the rings is not desirable or cost effective.

In each of the arrangements described above having multiple perforated lines to reduce the requirement to orient the container in the yoke, it is desirable to have as many perforated lines as possible consistent with maintaining the integrity of the yoke for carrying purposes. The greater the number of perforated or otherwise weakened lines, the smaller the maximum distance between the point of connection and a weakened line. This increases localization of the stress applied to break the ring at the weakened portion and aids removal of the container from the yoke.

Turning now to FIGS. 16 and 17 further alternative embodiments of the invention can be seen. The yoke 56 of FIG. 16 has no perforations and no weakened portions as do the previous embodiments. In this example, the yoke 56 is straddled by a brad 58 having a serrated cutting edge 60 on its inner side and positioned adjacent the yoke. The brad 58 must be curved sufficiently to prevent the cutting edge from making contact with the yoke and causing premature severance of the yoke 56. Preferably the cutting edge begins on the underside of the top part of the brad 58 as this is the point that will first contact the yoke on removal of the container. The brad 58 is attached to the top of the container near the edge and to the side of the container just below the yoke 56. This arrangement is particularly desirable for cans not having a neck portion above the location of the yolk to which the brad may be attached.

Alternatively as shown in FIG. 17, for containers having a neck portion 62 the brad 64 can straddle the yoke 66 by being connected to the neck portion of the container 62 and to the side of the container just below the yoke 66. Again the brad 64 must be sufficiently curved to prevent contact between the cutting edge 70 and the yoke 66, thereby avoiding premature rupture of the container.

With the arrangements of both FIG. 16 and FIG. 17, on removal of the container by the customer-familiar downward pull, the cutting edge 60 or 70 of the brad 58 or 64 respectively makes contact with the yoke. The cutting edge severs the yoke as the container is completely removed from the container package. The brad remains on the container and the cutting edge on the inside of the brad is so located that it does not interfere with the customer drinking the contents of the container. With a brad having an inner cutting edge, the brad may be positioned at any location on the can so that it straddles the ring engaging it at a point that does not comprise a part of an adjoining ring. With this embodiment, there is no need for a weakened portion of the yoke. It may however be preferable to locate the brad at a position remote from the push-tab so as not to interfere with drinking or pouring the contents of the can.

While several preferred embodiments of this invention are illustrated, it will be understood, of course that the invention is not limited to these embodiments, the principles disclosed in detail above to render the six-pack yoke safe can equally be applied to rendering the plastic rings from larger container packages safer for wildlife. Those skilled in the art to which the invention pertains may make modifications and other embodiments employing the principles of the invention, particularly upon considering the foregoing teachings.

What is claimed is:

1. A container package comprising:

a series of similarly configured containers;

a series of interconnected rings formed from a resilient deformable material, each surrounding and engaging one of an array of containers for maintaining the containers in adjacent relation;

connection means for linking each ring to the container with which it is engaged; and rupture means for breaching the continuity of each of the rings on removal of the container it engages from the container package.

2. The package of claim 1 wherein the connections means and rupture means comprise a bracket member straddling the girth of each of the rings and having an inner cutting edge for breaching the continuity of the rings it straddles on removal of the container it engages from the container package.

3. The package of claim 2 wherein the cutting edge is a serrated cutting edge.

4. The package of claim 1 wherein the rupture means comprises a weakened portion extending across the girth of the ring.

5. The package of claim 4 wherein the connection means is at least one fiber attached between the ring and the container.

6. The package of claim 5 wherein each of the containers is a can having a push-tab, the fiber being attached to the container at the underside of the push-tab by adhesive.

7. The package of claim 4 wherein the connection means is an adhesive.

8. The package of claim 7 wherein the adhesive is a single spot attaching the weakened portion of the ring to the container.

9. The package of claim 1 wherein the rupture means comprises a plurality of weakened portions located across the girth of each ring and extending around each ring between first and second locations.

10. The package of claim 9 wherein the connection means comprises a bracket member straddling the ring such that on removal of the container from its surrounding ring, stress applied to the ring by the bracket member ruptures at least one of the weakened portions of the ring.

11. The package of claim 10 wherein the weakened portions are each defined by a pair of perforated lines.

12. The package of claim 11 wherein the bracket member is substantially flush with the container.

13. The package of claim 12 wherein the bracket member is a pair of metal brads.

14. The package of claim 10 wherein the connection means is an adhesive.

15. The package of claim 14 wherein the adhesive is a single spot attaching the ring to the container at a point between the first and second locations.

16. The package of claim 14 wherein the weakened portions are each defined by a pair of perforated lines.

17. A container package comprising:

a series of similarly configured containers;

a series of interconnected rings formed from a resilient deformable material, each surrounding and engaging one of an array of containers for maintaining the containers in adjacent relation; and a bracket member straddling the girth of each of the rings, each bracket member having an inner cutting edge and linking each of the rings to the container with which it is engaged such that on removal of the container from the engaging ring the inner cutting edge of the bracket member makes contact with the ring it straddles causing the ring to rupture as the container is removed from the container package.

18. The package of claim 17 wherein the cutting edge is a serrated cutting edge.

19. A container package comprising:

a series of similarly configured containers;

a series of interconnected rings formed from a resilient deformable material, each surrounding and engaging one of an array of containers for maintaining the containers in adjacent relation and having a plurality of weakened, portions each defined by a pair of perforated lines extending across the girth of the ring; and an adhesive connecting each of the rings to the container with which it is engaged such that on removal of the container from the engaging ring, stress applied to the ring by the adhesive ruptures the ring along one of the pairs of perforated lines one located on either side of the adhesive.

20. The package of claim 19 wherein the adhesive is a single spot.

* * * * *